US008104800B2

(12) United States Patent
Lorek

(10) Patent No.: US 8,104,800 B2
(45) Date of Patent: Jan. 31, 2012

(54) MOBILE REFRIGERATOR WITH A DOOR LOCKING SYSTEM HAVING A STRIKER CATCH

(75) Inventor: Manfred Lorek, Siegen (DE)

(73) Assignee: Dometic GmbH, Siegen (DE)

( * ) Notice: Subject to any disclaimer, the term of this patent is extended or adjusted under 35 U.S.C. 154(b) by 205 days.

(21) Appl. No.: 12/019,869

(22) Filed: Jan. 25, 2008

(65) Prior Publication Data

US 2009/0007608 A1 Jan. 8, 2009

(30) Foreign Application Priority Data

Feb. 5, 2007 (DE) ..... 20 2007 001 638 U

(51) Int. Cl.
*E05C 19/10* (2006.01)
*E05C 19/12* (2006.01)

(52) U.S. Cl. ..... 292/108; 292/114; 292/DIG. 71

(58) Field of Classification Search ..... 292/56, 292/57, 95–99, 100–101, 109, 110, 113, 292/114, 121–123, 125–128, 10, 11, 17, 292/19, 107, 13, 102, 108, 194, 219, 220, 292/225, 228, 195, 198, 202, 203, 209, 210, 292/303, 304, DIG. 11, DIG. 71, 332, 137, 292/138, 145, 146, 150, 302, 336, DIG. 63; 312/405; 49/394
See application file for complete search history.

(56) References Cited

U.S. PATENT DOCUMENTS 67,518 A * 8/1867 Farmer ..... 292/238
95,231 A * 9/1869 Jones ..... 292/288
284,519 A * 9/1883 Warren ..... 292/109
960,381 A * 6/1910 Neuenschwander ..... 292/136
983,647 A * 2/1911 Romines ..... 292/111
1,046,336 A * 12/1912 Schatz ..... 292/114
1,155,953 A * 10/1915 Morrow ..... 292/130
1,291,886 A * 1/1919 Hill ..... 292/17
1,487,478 A * 3/1924 Rubin ..... 292/242
1,686,417 A * 10/1928 Norman ..... 292/108
3,120,971 A * 2/1964 Bengtsson ..... 292/91
3,339,956 A * 9/1967 Bencene et al. ..... 292/127
4,261,605 A * 4/1981 Hock ..... 292/228
4,478,444 A * 10/1984 Kurz et al. ..... 292/333
4,540,208 A * 9/1985 Logan et al. ..... 292/341.19
4,647,088 A * 3/1987 Nelson ..... 292/136
4,648,637 A * 3/1987 Walter ..... 292/128
(Continued)

FOREIGN PATENT DOCUMENTS

CH 326464 12/1957
(Continued)

*Primary Examiner* — Carlos Lugo
*Assistant Examiner* — Alyson M Merlino
(74) *Attorney, Agent, or Firm* — Pearne & Gordon LLP

(57) ABSTRACT

A mobile refrigerator with a refrigerator door is held magnetically against the body thereof. An additional hook lock (1 and 19) automatically engages on closing the refrigerator door and releases the refrigerator door only following the actuation of an unlocking mechanism. The unlocking mechanism disengages the hook bolt (7) from the lock striker (20), characterized in that the hook lock (1 and 19) comprises a locking member (14) by means of which the hook bolt (7) may be restrained in a disengaged position so that the refrigerator door is only held closed magnetically. The hook lock (1 and 19) is also characterized in that the locking member (14) is able to be so actuated independently of the unlocking mechanism that the hook bolt (7) is set in the disengaged position.

23 Claims, 8 Drawing Sheets

U.S. PATENT DOCUMENTS

| | | | | |
|---|---|---|---|---|
| 5,174,617 | A * | 12/1992 | Huber et al. | 292/128 |
| 5,490,698 | A * | 2/1996 | Dezso | 292/138 |
| 5,702,135 | A * | 12/1997 | Burress | 292/145 |
| 5,988,709 | A * | 11/1999 | Lee et al. | 292/199 |
| 6,334,282 | B1 * | 1/2002 | Wood | 52/202 |
| 7,032,973 | B2 * | 4/2006 | Reubeuze | 297/378.13 |
| 2005/0127697 | A1 * | 6/2005 | Berry | 296/24.3 |
| 2005/0189785 | A1 * | 9/2005 | Harder | 296/171 |
| 2006/0103154 | A1 * | 5/2006 | Berry | 296/24.39 |
| 2006/0220392 | A1 * | 10/2006 | Watanabe et al. | 292/241 |
| 2007/0042698 | A1 * | 2/2007 | Negley et al. | 454/139 |

FOREIGN PATENT DOCUMENTS

| | | |
|---|---|---|
| FR | 2131119 | 11/1972 |

* cited by examiner

MOBILE REFRIGERATOR WITH A DOOR LOCKING SYSTEM HAVING A STRIKER CATCH

BACKGROUND OF THE INVENTION

In the case of mobile refrigerators for leisure campers, caravans, boats or the like it is normal for the refrigerator door to be provided with magnetic strips all around it. In the closed state such strips pull toward corresponding metallic abutment in the refrigerator housing. They thus ensure that the refrigerator door is sealed in its engagement with the housing right the way around. This is more particularly desired in difficult conditions involved on the road, during which the mobile refrigerator is subjected to vibrations, twisting loads and acceleration, which have a tendency to disengage the refrigerator door temporarily from the body of the refrigerator.

Conventionally a refrigerator door will have a compartment in which bottles may be placed. Such bottles load the refrigerator door during travel and exert relatively heavy inertial forces thereon. Moreover, they tend, in unfavorable conditions, to pull the refrigerator door open, when the vehicle is parked on a slope, as is sometimes not to be avoided even on camping sites.

Accordingly suggestions have already been made to fit such mobile refrigerator additionally with a hook bolt which snaps home as soon as the refrigerator door is closed and holds the refrigerator door by interlocking engagement. In order to open the refrigerator door again it is firstly necessary to disengage the hook bolt. This is usually done by thrusting on a knob, which is let into the top edge of the refrigerator door, for example by way of a linkage so that the hook bolt is shifted upward and brought out of engagement with the striker (so-called unlocking mechanism). Such a hook lock ensures that the magnetic closing forces are not overridden by accident with an unintended opening of the door.

Such self-locking hook locks are employed because other additional locking means which must be mindfully operated to function, have not proved successful. For it has been found in practice that in the case of additional but not automatic locking means the user often forgets to lock them up. The refrigerator door will then open of its own accord at the next sharp corner. As a result the entire contents of the refrigerator will be tipped out as a mess in the interior of the leisure vehicle. In the special case of campers there may even be dangers, when the owner is forgetful and fails to lock the additional locking means prior to starting off. This is particularly so in the case of refrigerators mounted athwart the direction of travel in the rear part of the camper or trailer. In the case of such refrigerators there is the danger of the refrigerator door springing open when the vehicle is suddenly braked so that the contents of the refrigerator are all spilt into the driver part of the vehicle, which is normally not shut off from the living room part of the caravan.

The use of additional automatically locking bolts of known type does however lead to problems. On the one hand in the particular case of mobile homes sojourning for several weeks at a single site, it is decidedly inconvenient to grope around in the confined interior of the vehicle normally used by several persons, and only to be able to open the refrigerator door after a separate unlocking knob has been depressed, instead of just opening the refrigerator door with one hand in a single movement, as one is wont to do at home. Difficulties are entailed in such cases in the particular case of families with small children. The unlocking knob, normally placed adjacent to the top edge of the refrigerator door is often out of the reach of small children. This is more particularly the case when the refrigerator is installed with a space underneath it for storage purposes. Owing to this grown-ups will have to stand up in the course of family meals an unnecessary number of times from the table.

Accordingly it is one object of the invention to provide a mobile refrigerator which is so locked by a hook lock that on the one hand the user continuously on the road has much less chance of forgetting locking the refrigerator door as necessary during traveling while on the other hand there is a possibility of opening the mobile refrigerator during prolonged sojourns conveniently with a single movement without having to firstly unlock the door.

The locking member restraining the hook bolt in a disengaged position and accordingly preventing engagement of the hook bolt renders it possible to permanently deactivate the hook bolt as soon as the leisure vehicle is off road at a single site and there is accordingly no necessity of securing the refrigerator door against its accidentally springing open. On the other hand the hook bolt can be rapidly and permanently activated again, when the leisure vehicle is to be on the road again. The locking member may communicate with a signal producing means which, at an appropriate time, produces a "hook bolt deactivated" warning signal, for example, when the driver turns on the ignition of the vehicle, retracts supports or takes other measures indicative of starting a journey.

Preferably the locking member is so fashioned that it may be operated independently of the unlocking mechanism and ideally so that the unlocking mechanism and the locking member are completely uncoupled from one another, i. e. from the unlocking mechanism because the hook bolt is held in the disengaged position and the unlocking mechanism is not forced to assume any particular position. This means not only a simplification of design. In fact, it is now also possible to ensure that user of a locking member will not make necessary any change as regards the unlocking mechanism, which has proved satisfactory.

In the prior art a wide variety of hook locks has been proposed in a quite different context. As a rule such hook locks are utilized for locking sliding windows or sliding doors in buildings.

Many of the prior art hook locks also already have a locking member in the widest sense of the term. A known locking member is in a position of holding the hook bolt in the disengaged position, when the sliding door or the sliding window is to remain free for movement in either direction, i. e. when locking of the hook lock is to be avoided as soon as the two halves of the sliding of the sliding window meet. Such locks are however relatively complex in structure. For in the case of such locks an attempt is made to so design the unlocking mechanism in any case present for disengaging the engaged hook bolt in the course of opening of the sliding door or of the sliding window that it is in a position of holding the hook bolt in the disengaged position.

Thus the French patent publication 2 131 119 discloses a hook lock for a sliding door or a sliding window, in the case of the hook bolt is held pivotally on the housing and on its rear side bears teeth. These teeth are engaged by a linearly moving rack. The rack is connected with the unlocking mechanism (for the hook bolt) as such for the hook bolt lock. Provided that the unlocking mechanism is suitably designed the rack may be locked in a position in which the hook bolt is disengaged.

The design of this lock is comparatively complex, since the hook bolt must be provided with teeth which must be either relatively accurately manufactured or must be lubricated to keep the actuating forces within limits. Furthermore in the case of this design the locking member is not able to be operated independently of the unlocking mechanism. Owing to such features the known hook lock is quite expensive to manufacture and furthermore care must be taken as regards the unlocking mechanism to ensure that the locking function of this lock may also be effective.

The Swiss patent publication CH 326464 discloses a hook lock for sliding room closure element, which is operated using an actuating rod, which shifts a four cornered thrust member to and fro. On the actuating rod there is a ledge which holds the hook bolt in the disengaged position as long as the actuating rod is restrained by the thrust member in its top position. This hook lock comprises a whole series of individual parts, is complex in structure and is correspondingly expensive. In this case as well it is not possible to use any desired sort of unlocking mechanism together with the hook lock since as regards the unlocking mechanism it is necessary to take into account the function of the lock itself.

Therefore a further aim of the invention is to provide a compactly designed hook lock comprising a bolt element and an associated striker element into which the hook bolt fits, the lock being suitable for installation as a module-like unit in a mobile refrigerator and which has an extremely simple configuration and offers the possibility of restraining the hook bolt in the disengaged position, while however representing a unit which operates substantially independently of the unlocking mechanism employed on the respective refrigerator.

BRIEF SUMMARY OF THE INVENTION

The hook lock designed on these lines constitutes a compact subassembly, in the case of which all components necessary for the bolt element are held in or on the bolt housing so that only the bolt housing must be attached in order to mount the entire bolt element as a self-contained unit. As regards the locking member no particular attention need be paid to the unlocking mechanism. The bolt element fitted with the locking member is also suitable for upgrading an existing structure. Accordingly a similar hook lock not having a locking member on a refrigerator door may be replaced by it.

In accordance with an advantageous further development of the invention the locking member is a slide moving linearly in the bolt housing and which may be thrust into a first position and held therein, in which it locks the hook bolt in a disengaged position and into a second position, in which it does not curtail the function of the hook bolt. A slide, which only requires a linear movement in order to be thrust from the first position into the second position s quite simple, only needs a minimum of guiding and support means on the bolt housing and only occupies a small amount of space.

Another advantageous further development is such that the slide runs on that end side of the bolt housing which has the window for the passage of the hook-like locking position, the slide here being guided in a groove on the outer side of the bolt housing. Accordingly the support and guidance of the slide is simple. This is because on one side the slide runs in this design on the end wall, present in any case, of the bolt housing. Accordingly on this end side of the bolt housing only a sort of extension must be provided, which holds the slide in contact with the guiding wall of the bolt housing. Furthermore the slide may then in this manner also be actuated even when the bolt housing, as is normally the case, is inside the refrigerator door on its two narrow longitudinal sides and at its narrow end side facing away from the locking portion and accordingly is not accessible.

In an advantageous fashion the groove surrounds the slide only in a portion thereof, ideally for less than 50% (of the main surface, i. e. the surface of the largest side of the slide). In other words, the groove only surrounds the slide so that the possible extreme positions of the slide and the functions performed by the slide in these positions are to be seen at a glimpse from the outside. In this case the slide is preferably molded using a plastic material having a color conspicuously different from that of the bolt housing. These measures are advantageous because leisure vehicles have quite long service lives and may often change owners many times. In this respect steps are frequently not taken to ensure that each new owner really gets the instruction manuals for the various pieces of equipment, to put him in the picture about its functions. It is therefore reasonable to design the slide so that each new owner is able to intuitively get a grasp of the functions of the slide and how it is to be handled.

By way of conclusion it is furthermore to be noted that the invention may be employed with advantage as well for mobile refrigerators in buses or modern trucks for long distance use, since the conditions here are similar to those in leisure vehicle. Moreover, the hook lock in accordance with the invention may also be employed in principle for other pieces of equipment, involving similar requirements to those of mobile refrigerators, in leisure vehicles such as oven doors held shut by a spring but benefiting from an additional lock.

Furthermore advantages and effects of the invention will be understood from the description of an embodiment in the following account.

DETAILED DESCRIPTION OF THE INVENTION

Figure 1:
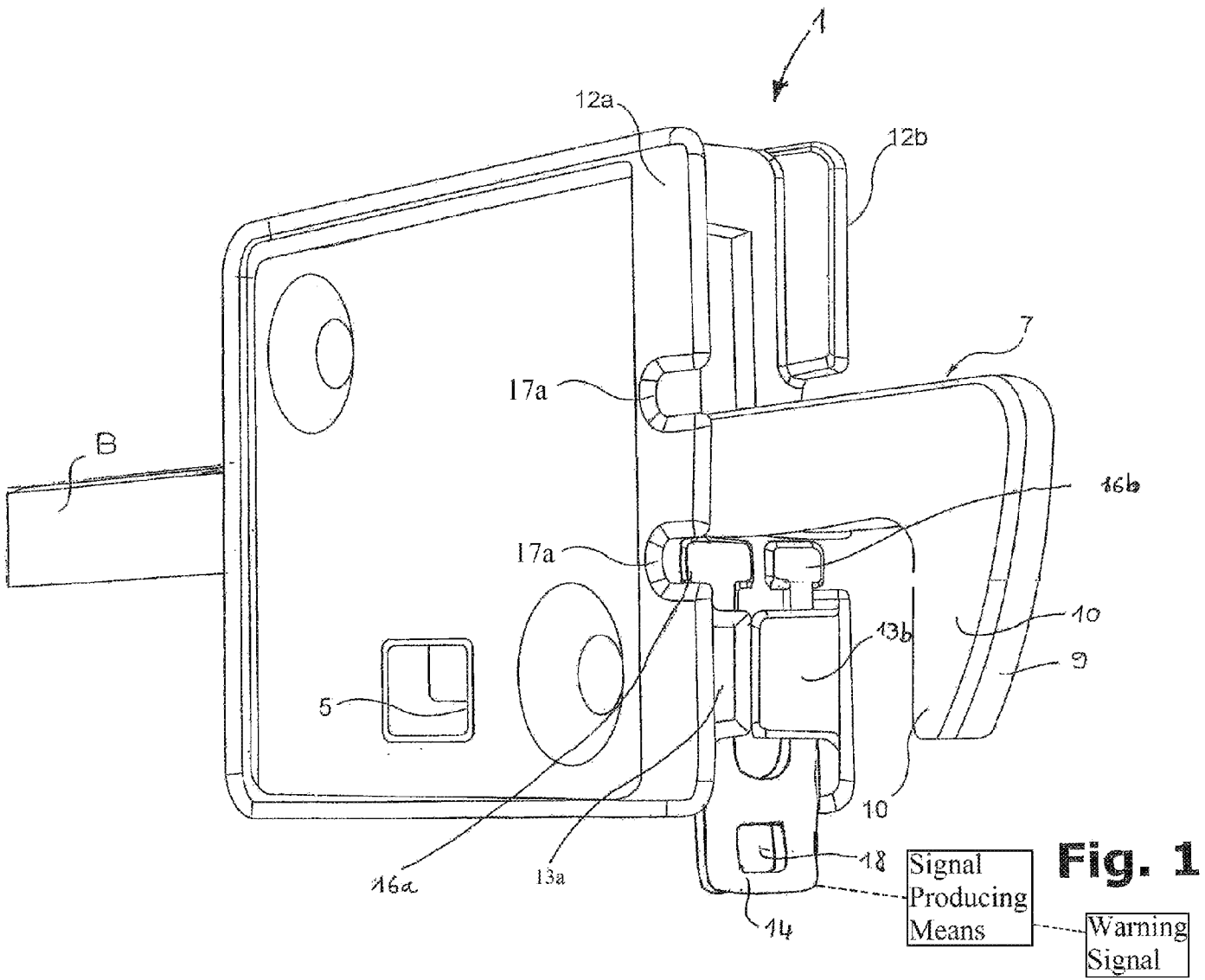
FIG. 1 shows a working example of the hook lock in accordance with the invention in the case of which the slide is located in the deactivated position, i. e. in its second position, in which it does not limit the function of the hook bolt.
Figure 3:
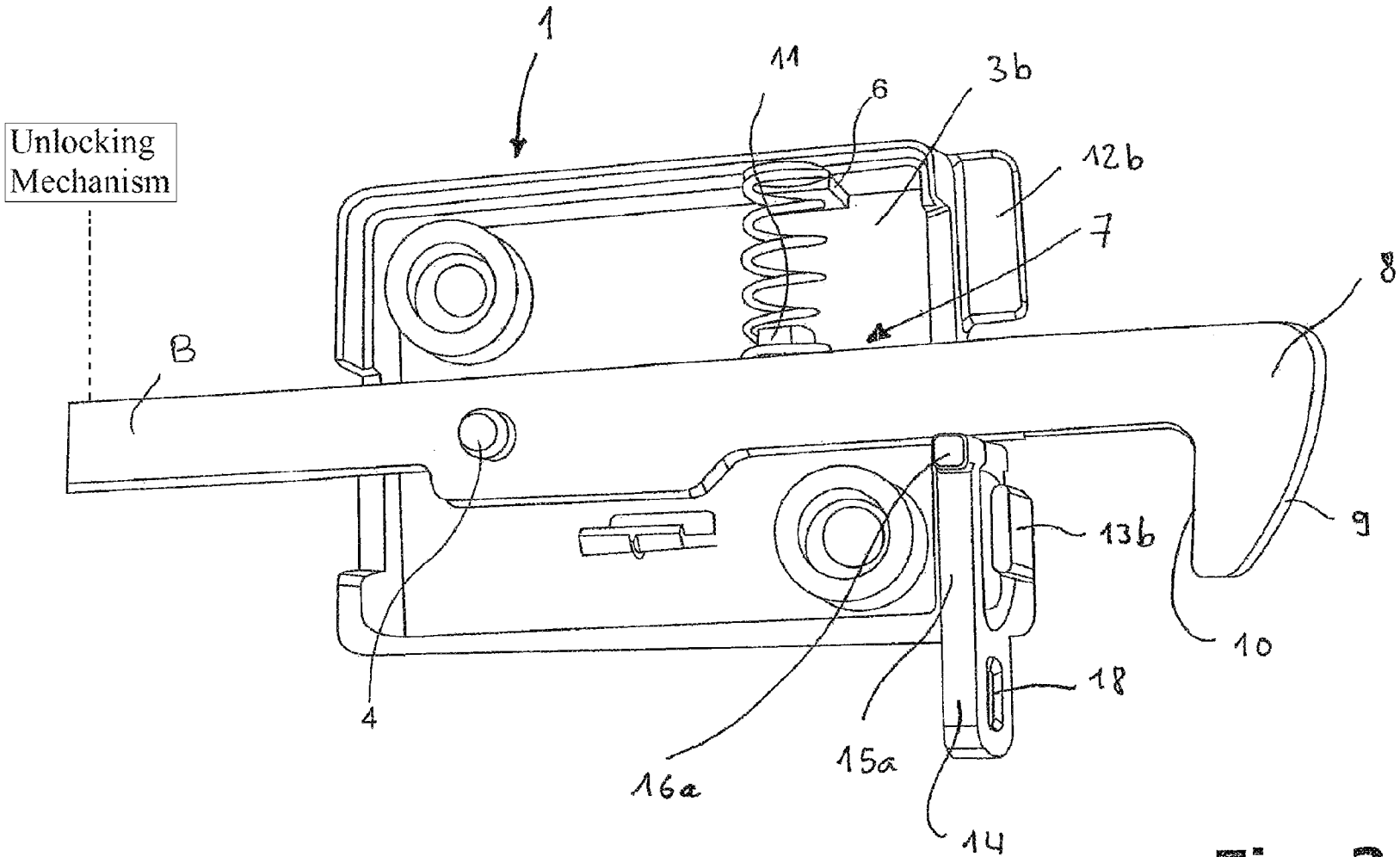
FIG. 3 shows the working embodiment of FIGS. 1 and 2 in a condition in which the housing shell facing the reader is dismounted so that parts in the inner bolt housing may be seen.

With reference to the figures and more especially to FIGS. 1 and 3 it will be seen that the bolt housing is quite simple in its design. It comprises two preferably injection molded housing shells 3*a* and 3*b* able to be locked together by catch means, which as a rule are manufactured of some suitable plastic. For more expensive designs able to withstand heavy loads (crash-proof applications in mobile homes) metal injection castings also come into question.

The right hand housing shell 3*b* serves as a bearing and holding part. For this purpose it possesses a bearing pin 4 on which the hook bolt 7 is pivotally mounted. The bearing pin 4 is ideally made longer than is necessary merely for supporting the hook bolt 7. Accordingly it is possible, when the housing is assembled, to cause the bearing pin 4 to fit into a corresponding recess in the left hand housing shell, which is not illustrated in FIG. 3 so that the bearing pin 4 is supported by the left hand housing shell. Although the bearing pin is hollow in order to avoid undesired accumulations of material in the case of injection molding, it will not break off, owing to this feature, even if the hook bolt is subjected to a violent tension force—for example if the refrigerator contents should be slung from the inside against the refrigerator door in the case of abrupt braking or in the case event a traffic accident.

The housing shells 3*a* and 3*b* have a well 6 at their top inner side for a helical spring to bear against.

Finally the right hand housing shell 3*b* has a detent spur 5, which in the mounted condition fits into a corresponding detent opening in the left hand housing shell 3*a*. This simple detent spur 5 is not able to transmit heavy forces. However it is sufficiently strong to hold the two housing shells 3*a* and 3*b* together until fitted to the piece of furniture.

For the purpose of assembly the bolt housing has two or more through openings for assembly screws. They are so made that the assembly screws not only hold the bolt housing on the piece of furniture but also thrust the two housing shells firmly together.

The hook bolt 7 is preferably manufactured of metal, as for example in the form of a part stamped from thick aluminum sheet. The hook-like locking portion 8 has a ramp 9 on its outer side. The ramp thrusts the hook bolt 7 during closing of the refrigerator door upward into a position ready for engagement as soon as the hook bolt strikes an outer edge 21 of the lock striker 20. The hook-like locking portion has on its inner side an oblique portion 10 running in such a direction that the hook bolt 7 does not under load have any tendency to disengage and on the contrary tends to be more and more firmly hooked on the lock striker. Finally the hook bolt has a stud 11 on its top narrow side. This stud 11 serves as a bearing stud. Together with the already mentioned well 6 in the bolt housing it holds a helical spring in the compressed condition.

This helical spring urges the hook bolt 7 toward the engaged position. This takes place in a simple and effective fashion. The helical spring is promptly not only subjected to compression along its principal axis but also to a bending force pivotally in relation to its principal axis, since it is held fast between the bolt housing and the hook bolt.

The hook bolt 7 has its locking portion 8 (which is to engage the striker) projecting on the one side, and on the its other side has its elongated beam-like extension extending out of the bolt housing, see FIG. 3. The function of this beam-like portion will be explained below. In other respects the hook bolt 7 and the spring biasing it are surrounded by the bolt housing consisting of the two housing shells 3*a* and 3*b*, or even completely surrounded thereby. Accordingly there is a compact bolt element consisting of only a few parts and therefore economic to manufacture, i. e. a bolt module.

The locking member is in this case designed in the form of a slide 14, this allowing an extremely simple construction.

The support or guidance means of this slide 14 is disposed on the outer side of the bolt housing. For this purpose a respective lug 12*a* and 12*b* is molded on each housing shell 3*a* and 3*b* near the end side, eventually to face the locking portion, of the bolt housing, such lug representing essentially an extension of the major principal face of the respective housing shell. These lugs 12*a* and 12*b* provide lateral guidance for the slide 14, functioning as a locking member, which runs on the outside on the end side of the bolt housing.

At least one of the lugs, in the present case both of them 12*a* and 12*b*, bears a further perpendicularly disposed lug 13*a* and 13*b*. Owing to this the slide is in portions completely surrounded and slides in section thereof in a channel surrounding it like a belt.

Figure 4:
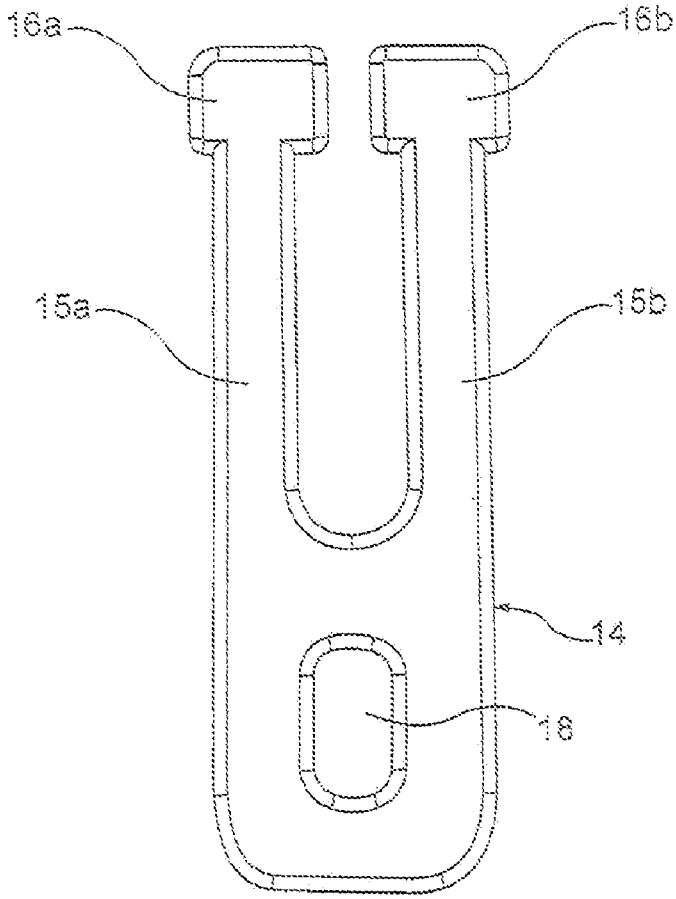
FIG. 4 shows the slide of the working example in a separate view.

The slide 14 itself basically has the form of a relatively thin elongated rectangular plate, see FIG. 4. In the working embodiment this plate is slotted for about two thirds of its length. The slotted portion constitutes two strip springs 15*a* and 15*b*, which at their outer end respectively bear a detent extension 16*a* and 16*b*. These detent extensions 16*a* and 16*b* each fit in recesses 17*a* and 17*b* assigned to them and into the lug 12*a* and 12*b* provided for lateral guidance. Accordingly the slide may be held in a first position, in which it restrains the hook bolt in the disengaged position and in a second position, in which it does not restrict the function of the hook bolt. This first position is illustrated in FIG. 1 whereas the second position is depicted in FIG. 2.

Figure 2:
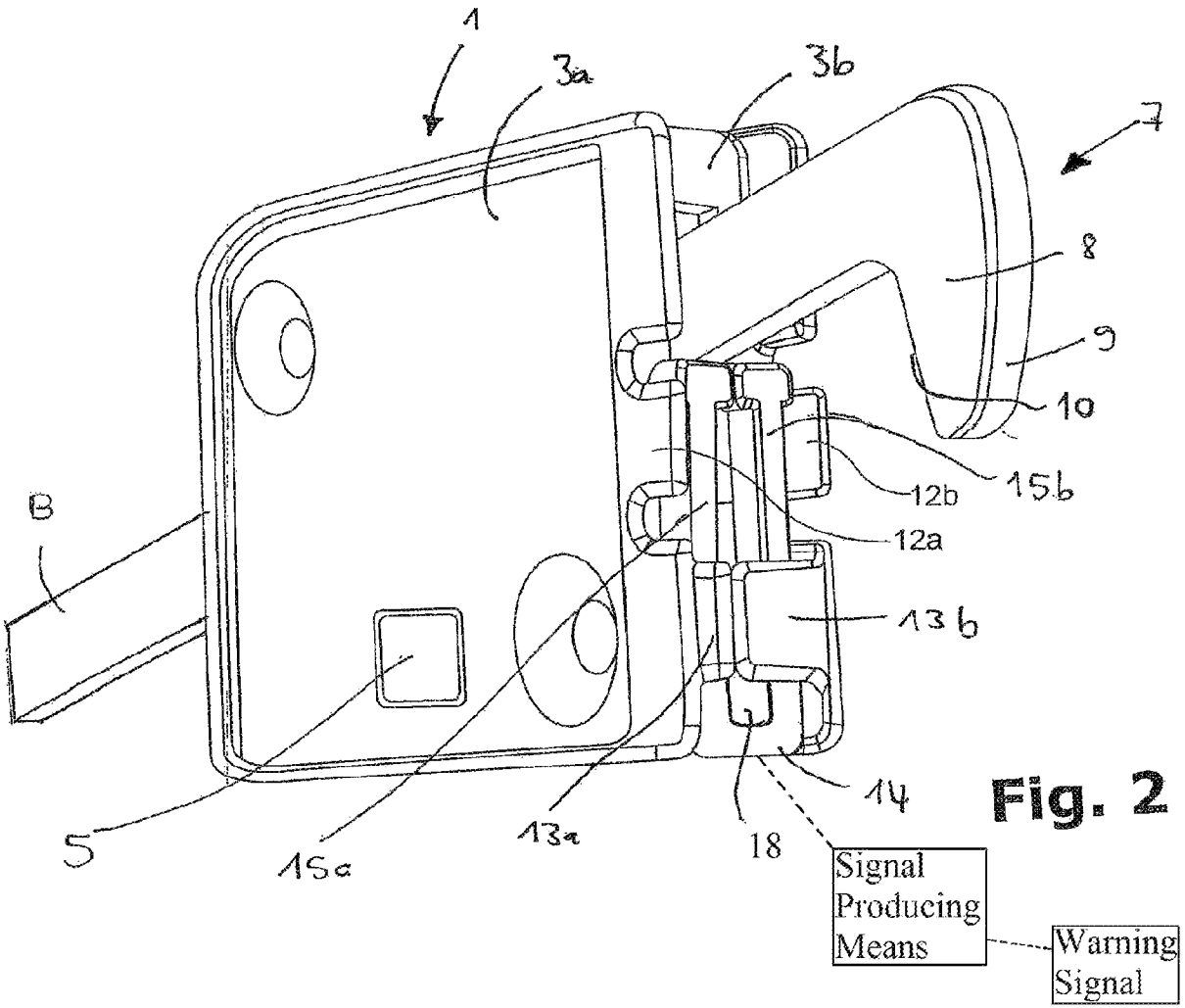
FIG. 2 shows the working embodiment of FIG. 1 at an instant in which the slide is just short of its first position in which it acts as a catch and holds the hook bolt in its disengaged position.

FIG. 2 serves to make clear the function of the slide 14. When the slide is in its first upwardly shifted position, the two outer ends of the detent extensions 16*a* and 16*b* of the strip springs 15*a* and 15*b* simultaneously constitute a support face or respectively an abutment for the hook bolt. This support face supports the hook bolt and prevents the hook bolt from moving down further and into its engaged position. The hook bolt is consequently deactivated.

The reader will also see that the non-slotted portion of the slide 14 is provided with an opening 18, into which if required a pin, a narrow screw driver, the tip of a ball pen or the like may be introduced in order to shift the slide to and fro, see FIG. 4.

However as a rule the slide 14 can be shifted to and fro without any special tool. For the detent extensions 16*a* and 16*b* of its strip springs 15*a* and 15*b* and the corresponding detent recesses 17*a* and 17*b* in the lugs providing for lateral guidance are so configured that the slide may be readily thrust out of its first position into its second position not obstructing the hook bolt if the hook bolt as such is thrust by hand downward into its position corresponding to the engaged position. The thrust on the hook bolt shifts the slide out of its detent engagement and presses it downward into its second position, where it is caught again. Conversely the slide 14 may also be readily thrust out of its second into its first position. As illustrated in FIG. 1 in its second position it extends past the bottom edge of the hook bolt in a downward direction. Accordingly the slide 14 is readily accessible in order to be thrust upward.

Figure 7:
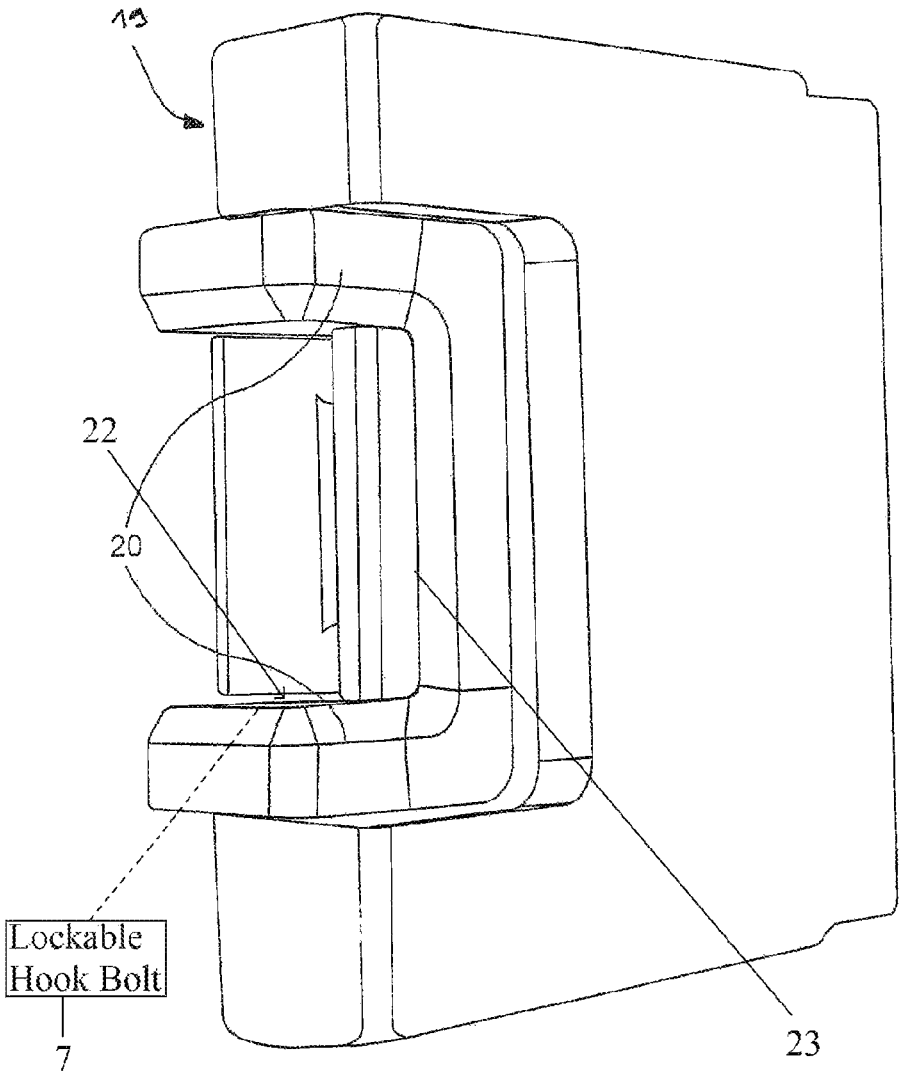
FIG. 7 is a detailed view of the guide for the slide.

As illustrated in FIGS. 2 and 7 at least the channel consisting of the two lugs 12*a* and 12*b* provided for lateral guidance and the third lugs 13*a* and 13*b* disposed perpendicularly thereto only constitutes a small fraction, i. e. a portion, which only fits around and covers a limited portion of the slide 14. The major part of the slide 14 therefore remains visible. Thus it is possible at any time, without pondering the matter and intuitively to see the function of the slide. This is more particularly so, when the slide is for example made of plastic with a red coloration and clearly to be distinguished from the white or gray bolt housing.

As already mentioned on its side at its locking portion for engaging the lock striker and on its other side with an elongated, beam-like extension, the hook bolt 7 projects out of the bolt housing. This elongated beam-like extension serves for coupling the unlocking mechanism, which for example consists of a strand and thrusts down against the beam-like extension, preferably without being permanently connected with the latter. The strand is for its part connected with a disengaging knob, which is let into the top edge of the refrigerator door.

Figure 6:
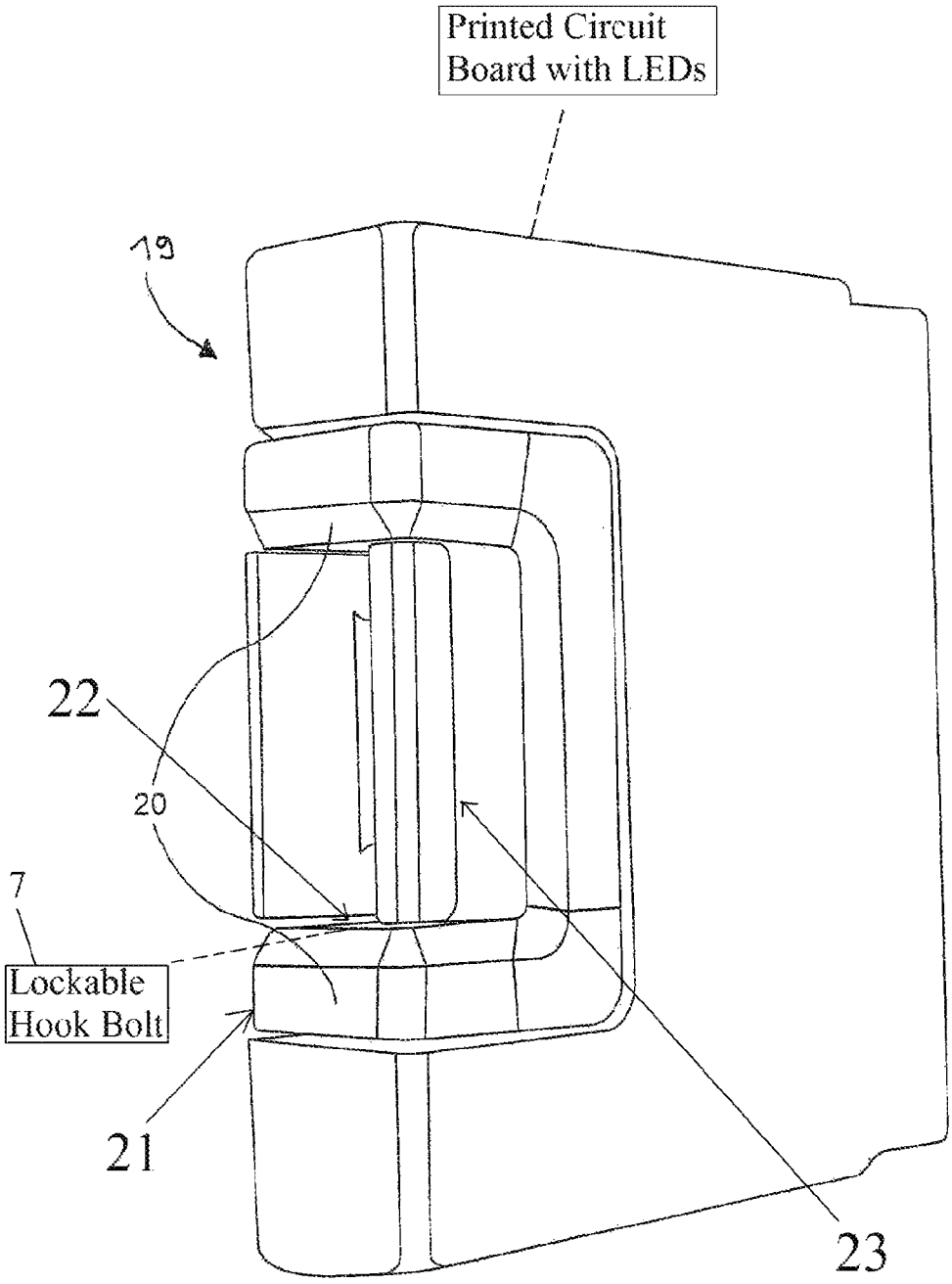
FIG. 6 shows the respective striker element with the lock striker drawn outward.

FIG. 6 shows the striker element 19. It comprises a housing, which bears the lock striker 20 as such surrounding an opening 22 into which the locking portion 8 of the hook bolt 7 fits. The housing also accommodates the refrigerator lights in the form of a printed circuit board with LEDs to shine into the interior of the refrigerator through a window with a translucent cover.

FIG. 7 shows the striker element with the lock striker pulled outward and held by a catch means 23 in this position. The lock striker renders it possible to restrain the refrigerator door in a position in which it leaves the door somewhat ajar so that the refrigerator is ventilated and even during long periods of non-use of the refrigerator and/or when the refrigerating space is not completely cleaned no unpleasant odors will be evolved and in fact the refrigerator interior may dry out.

Figure 5:
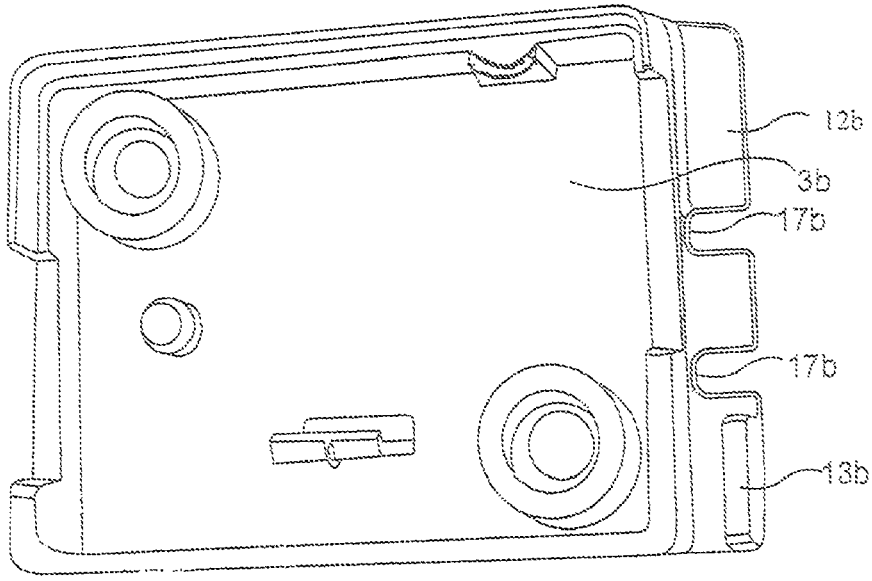
FIG. 5 shows the striker element belonging thereto.

FIG. 5 shows in detail how the slide 14 is supported for its movements, i. e. how the channel is designed whose construction is constituted in part by the right hand housing shell 3*b* with its lugs 12*b* and 13*b*.

Figure 8:
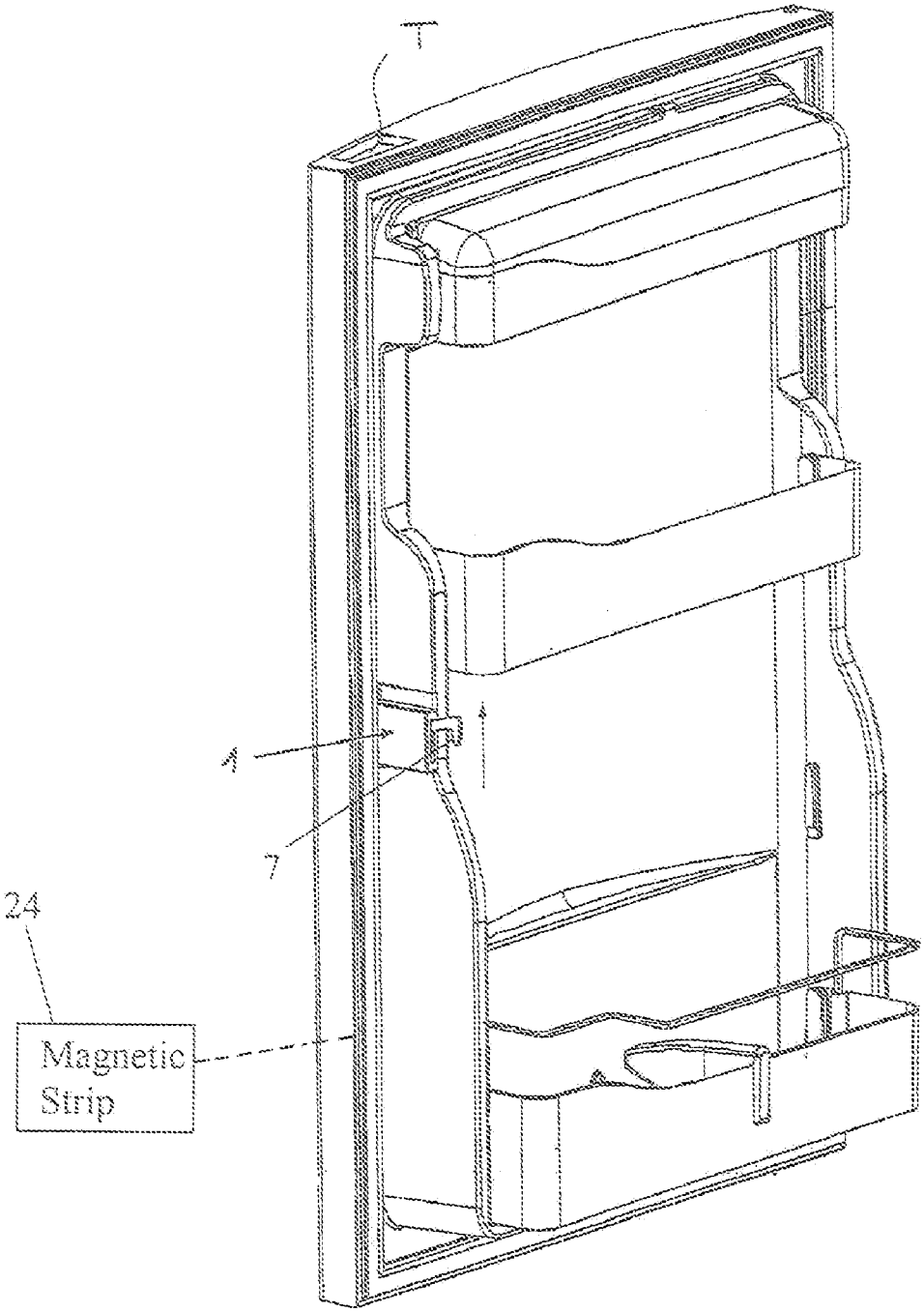
FIG. 8 shows the door of a refrigerator in accordance with the invention.

FIG. 8 shows the door of a mobile refrigerator designed in accordance with the invention. The knob T on the refrigerator door acts by way of a linkage (not illustrated, within the door) on the beam-like extension B of the hook bolt 7 in order to unlock the hook bolt 7. The refrigerator door may be provided with a magnetic strip 24 all around it.

Finally it is to be noted that the components above named the left hand and right hand housing shell, may also be termed the first and second housing shell. By the same token this will apply for all components, with reference to which the terms left and right are employed.

LIST OF REFERENCE NUMERALS

1 bolt element
2 bolt housing
3*a* first housing shell
3*b* second housing shell
4 bearing pin
5 detent spur for locking the housing shells together
6 well for helical spring
7 hook bolt
8 locking portion of the hook bolt
9 outer oblique portion of the hook bolt
10 inner oblique portion of the hook bolt
11 stud for helical spring
12*a* left hand lateral guide lug
12*b* right hand lateral guide lug
14 slide
15*a* left hand strip spring of the slide
15*b* right hand strip spring of the slide
16*a* detent extension of the left hand strip spring
16*b* detent extension of the right hand strip spring
17*a* detent recesses in the left hand lateral lug
17*b* detent recesses in the right hand lateral lug
18 opening in the slide
19 striker element
20 moving striker

The invention claimed is:

1. A mobile refrigerator comprising:

a refrigerator body;

a refrigerator door magnetically retained to the refrigerator body;

a hook lock system, which engages upon closing the refrigerator door and which permits opening of the refrigerator door only after actuation of an unlocking mechanism that disengages a hook bolt from a striker, further wherein the hook bolt is insertable into an opening of the striker such that an oblique portion of the hook bolt engages the striker, a locking member for restraining the hook bolt in a disengaged position such that the refrigerator door is only magnetically retained in the closed position, wherein the locking member is actuatable independently of the unlocking mechanism and is provided for restraining the hook bolt in the disengaged position, and a bolt housing into which the hook bolt is pivotally mounted, wherein the locking member is guided by an end side of the bolt housing;

further wherein the locking member is a slide that is configured to slide with respect to the bolt housing that is thrustable into a first position, in which the locking member restrains the hook bolt in the disengaged position by engaging a plurality of recesses in the bolt housing, and is retainable in that first position, further wherein the locking member is movable into a second position, in which the slide does not restrict the functioning of the hook bolt.

2. A hook lock system for a mobile refrigerator, comprising:

a striker assembly including a striker;

a bolt assembly, including a hook bolt, which at its one end possesses a hook-shaped locking portion wherein the hook-shaped locking portion is insertable into an opening of the striker such that an oblique portion of the hook bolt engages the striker, and a bolt housing, into which the hook bolt is pivotally mounted and that has a window from which the hook-shaped locking portion protrudes and which includes a spring biasing the hook bolt in an engaged position; and a locking member that is independently operable from an unlocking mechanism for unlocking the hook bolt from the striker, wherein the locking member is configured to fasten the hook bolt in a disengaged position, thereby overriding the spring bias, such that the hook bolt does not hook on the striker, further wherein the locking member is guided by an end side of the bolt housing;

further wherein the locking member is a slide that is configured to slide with respect to the bolt housing that is thrustable into a first position, in which the locking member restrains the hook bolt in the disengaged position by engaging a plurality of recesses in the bolt housing, and is retainable in that first position, further wherein the locking member is movable into a second position, in which the slide does not restrict the functioning of the hook bolt.

3. The hook lock system of claim 2, wherein the slide is guided by the bolt housing's end side, the end side including the window for the passage of the hook-shaped locking portion of the hook bolt, wherein the slide is further guided by a groove on the end side of the bolt housing.

4. The hook lock system of claim 3, wherein the groove surrounds the slide only in part such that the end positions of the slide and the functions of the slide at those end positions are readily perceivable from the outside.

5. The hook lock system of claim 4, wherein the groove surrounds less than 50% of the slide.

6. The hook lock system of claim 4, wherein the slide is made of injection-molded plastic material, which is colored differently to the plastic material of the bolt housing in a conspicuous manner.

7. The hook lock system of claim 2, wherein the position of the slide determines the size of the window opening, which in turn determines the degree of freedom of movement of the hook-shaped locking portion.

8. The hook lock system of claim 2, wherein the slide has the shape of a plate with a slotted portion at one end, wherein the slotted portion forms two strip springs each with a detent extension, the detent extensions are lockable into corresponding recesses in the bolt housing such that that the slide is releasably retainable in the second position.

9. The hook lock system of claim 8, wherein the engagement portion is a hole in a non-slotted portion of the slide.

10. The hook lock system of claim 2, wherein the slide has an engagement portion engageable by the hand or with a tool for shifting the slide from the first position into the second position, thereby overriding the engagement with the plurality of recesses restraining the slide in the second position and the spring that biases the hook bolt in the engaged position.

11. The hook lock system of claim 2 wherein at least one detent extension of the slide restrains the hook bolt in the disengaged position, and wherein the slide is movable between restraining the hook bolt in the disengaged position to the second position, wherein when the hook bolt is in the engaged position, the slide does not restrict the function of the hook bolt and does not exert pressure on the hook bolt.

12. The hook lock system of claim 2, wherein the slide, when it is located in its second position, in which it does not restrict the function of the hook bolt, overlaps a bottom edge of the bolt housing in a downward direction with respect to the bottom edge of the bolt housing, such that that a portion of the slide extends freely from the bolt housing for thrusting the slide upwardly into its first position, wherein the thrusting is in essence not restricted by the bolt housing.

13. The hook lock system of claim 2, wherein a part of the hook bolt, which is at the opposite end of the hook-shaped locking portion, protrudes from the bolt housing and said part of the hook bolt, which projects from the bolt housing, forms a portion for coupling with the unlocking mechanism.

14. The hook lock system of claim 2, wherein the spring is accommodated in the interior of the bolt housing.

15. The hook lock system of claim 2, wherein the spring is a helical spring, which is housed in the bolt housing between at one end by a well of the bolt housing and at the other end by a stud of the hook bolt and is prevented from moving out of position by the bolt housing and the hook bolt.

16. The hook lock of claim 15, wherein the spring is positioned and retained such that the spring is not only loadable by a force in the direction of its principal axis, but also by bending the spring athwart its principal axis.

17. The hook lock system of claim 3, wherein the groove guiding the slide has an opening on one side such that the slide is configured to be introduced into the groove from the outside of the bolt housing.

18. The hook lock system of claim 2, wherein the bolt housing is made of two parts and has mounting screw openings for securing the bolt housing to a refrigerator door of the mobile refrigerator, wherein the mounting screw openings are so aligned and arranged such that the two parts of the bolt housing are held together force-fittingly by mounting screws once the mounting screws are screwed in.

19. The hook lock system of claim 2, wherein the striker assembly is provided with a movable portion, wherein the movable portion is releasably connected in an advanced position by a catch such that the hook bolt is lockable in the movable portion, wherein the oblique portion engages the striker for maintaining the door in a position, in which a refrigerator door of the mobile refrigerator is left ajar for ventilation of a refrigerating space.

20. The hook lock system of claim 2, wherein the striker assembly comprises lights for illuminating the mobile refrigerator when a refrigerator door of the mobile refrigerator is open.

21. The hook system of claim 2, wherein the mobile refrigerator is housed in a vehicle, further wherein the locking member is coupled to a signal producing means which is configured to generate a "hook bolt deactivated" warning signal.

22. A mobile refrigerator comprising:

a refrigerator body;

a refrigerator door magnetically retained to the refrigerator body in a closed position;

a hook lock system engageable upon closing the refrigerator door, the hook lock system comprising a hook bolt movable within the hook lock system between an engaged and disengaged position, an unlocking mechanism adapted to move the hook bolt to the disengaged position, and the hook lock system including a striker adapted to engage the hook bolt when the hook bolt is in the engaged position; and a locking member for restraining the hook bolt in the disengaged position such that the refrigerator door is only magnetically retained in the closed position, and wherein the locking member is operated independently of the unlocking mechanism, further wherein the locking member includes a slotted portion at one end forming two strip springs;

further wherein the locking member is a slide that is configured to slide with respect to a bolt housing that is thrustable into a first position, in which the locking member restrains the hook bolt in the disengaged position by engaging a plurality of recesses in the bolt housing, and is retainable in that first position, further wherein the locking member is movable into a second position, in which the slide does not restrict the functioning of the hook bolt.

23. A hook lock system for a mobile refrigerator, wherein the hook lock system comprises:

a striker assembly including a striker;

a bolt assembly, including a hook bolt, which at its one end possesses a hook-shaped locking portion, wherein the hook-shaped locking portion is configured to be insertable into an opening of the striker, such that the hook-shaped locking portion engages the striker, a bolt housing, into which the hook bolt is pivotally mounted, has a window from which the hook-shaped locking portion protrudes and which includes a spring configured to bias the hook bolt in an engaged position; and a locking member that is independently operable from an unlocking mechanism for unlocking the hook-shaped locking portion from the striker, wherein the locking member is configured to fasten the hook bolt in the disengaged position, thereby overriding the spring bias, further wherein the locking member is a slide that is linearly slidable with respect to a guide structure of the bolt housing that is thrustable into a first position, in which the locking member restrains the hook bolt in the disengaged position, and retainable in the first position, and that is movable into a second position, in which the slide does not restrict the functioning of the hook bolt.

* * * * *